US006018838A

United States Patent [19]

Nowack

[11] Patent Number: 6,018,838

[45] Date of Patent: Feb. 1, 2000

[54] TOOTHBRUSH

[76] Inventor: Duane C. Nowack, 16722 Shady Oaks Dr., Ramona, Calif. 92065

[21] Appl. No.: 08/840,141

[22] Filed: Apr. 11, 1997

[51] Int. Cl.[7] ..... A46B 9/04

[52] U.S. Cl. ..... 15/167.1; 15/143.1

[58] Field of Search ..... 15/143.1, 167.1

[56] References Cited

U.S. PATENT DOCUMENTS

| | | | |
|---|---|---|---|
| D. 107,228 | 11/1937 | Goodman | 15/167.1 |
| D. 109,472 | 5/1938 | Clarren | 15/167.1 |
| D. 151,237 | 10/1948 | Harris | 15/167.1 |
| 669,402 | 3/1901 | Rose | 15/167.1 |
| 760,047 | 5/1904 | Wilson | 15/167.1 |
| 1,647,453 | 11/1927 | Krantz | 15/167.1 |
| 2,161,349 | 6/1939 | Hadden | 15/167.1 |
| 2,835,912 | 5/1958 | Pensky | 15/167.1 |
| 4,274,174 | 6/1981 | Ertel | 15/167.1 |
| 4,399,582 | 8/1983 | Ernest | 15/167.1 |
| 4,457,039 | 7/1984 | Massari | 15/167.1 |
| 4,679,273 | 7/1987 | Okin | 15/167.1 |
| 5,242,301 | 9/1993 | Hickey | 15/167.1 |
| 5,517,713 | 5/1996 | Hadcock | 15/167.1 |

FOREIGN PATENT DOCUMENTS

| | | | |
|---|---|---|---|
| 570586 | 2/1933 | Germany | 15/167.1 |

*Primary Examiner*—Randall E. Chin

[57] ABSTRACT

A toothbrush having three section including a head section having bristles, a handle section for griping the toothbrush and a connecting section for connecting the head section to the handle section. In two embodiments the head is parallel to but offset from the longitudinal axis of the handle so that the connecting section and handle do not interfere with the anterior teeth. This allows perpendicular contact of the bristles with the lingual surface of the posterior teeth and the gingiva. The handle is offset above the head so that the connecting section and the handle do not obstruct the view of the lingual surfaces of the posterior teeth while they are being cleaned. A third embodiment, the head at an angle to and is offset below the longitudinal axis of the handle. The bristles are of equal length so that when they are placed perpendicular against the lingual surfaces of the posterior teeth and the gingiva, the connecting section and the handle are away from the anterior teeth and the connecting section and the handle do not obstruct the view of the lingual surfaces of the posterior teeth while they are being cleaned.

1 Claim, 2 Drawing Sheets

TOOTHBRUSH

FIELD OF THE INVENTION

The present invention relates to improved toothbrush designed to have full bristle contact with the lingual surfaces of posterior teeth and a clear view of the lingual surfaces while they are being cleaned.

BACKGROUND OF THE INVENTION

Having clean teeth and healthy gums is an important aspect of daily hygiene. It helps prevent the unwanted expense of dental surgery, tooth loss and the expense associated with repairing or replacing teeth. Improvements in toothbrush design have been made to more effectively clean tooth and gum areas such as the open interproximal area that are likely to develop tooth decay or gum disease. The formation and accumulation of plaque on the teeth is a common cause of gum disease and tooth loss. After plaque is formed, it can be calcified if not removed within a day. Once calcified, the plaque must be removed by a dentist. Almost any tooth brush can be effectively used to remove plaque from the outside or facial surfaces of the teeth. However, removal of the plaque from the inside interproximal surface of the molars, premolars, canine and incisors is inhibited by the angle of the bristles in relation to the handle of the toothbrush. Specifically, the handles of the brushes do not allow maximum contact between the bristles and the inside interproximal surfaces of the teeth. This lack of contact is shown most effectively in FIG. 7 of U.S. Pat. No. 5,046,212. Also, the handles of prior art toothbrushes tend to impair a persons ability to see the surfaces of the posterior teeth they are trying to clean. It important for the person cleaning their teeth to see the areas being cleaned so that areas will not be missed.

One of the hardest places to clean is the inside or lingual surface of the posterior teeth. Previous patents such as U.S. Pat. No. 4,800,608 address the cleaning of the outside of the posterior teeth using a bristle head with an included angle as shown in FIG. 4 of that Patent. U.S. Pat. No. 5,046,212 shows a toothbrush body having a bristle head at one end and an offset neck connecting the bristle head to a straight handle. As shown in FIG. 7, only a portion of the bristles come in contact with the internal embrasure and lingual surface of the posterior teeth. U.S. Pat. No. 4,672,706 shows a toothbrush similar to prior art FIG. 1A of the present application. The bristle head in FIG. 2 of the '706 patent is offset from the longitudinal axis of the handle in a manner that will hinder full contact of the bristles with the lingual surface of the posterior teeth. U.S. Pat. No. 4,356,585 shows a toothbrush head that is located entirely below the longitudinal axis of the handle. The head is not parallel to the longitudinal axis of the handle and the bristle tufts are of unequal length such that the bristles are progressively longer traveling away from the handle. When this toothbrush is placed so the bristles are flat against the lingual or buccal surfaces of the posterior teeth, the offset connecting portion between the head and the handle blocks the view of these surfaces by the person who is brushing their teeth. This is a disadvantage in that some hard to clean areas such as the lingual surfaces of the posterior teeth may be missed or cleaned less effectively. U.S. Pat. No. 4,724,570 shows a toothbrush having a head with bristles that are longer and softer along the centerline and shorter and stiffer toward the outer edge of the toothbrush head to facilitate cleaning of the sulcus and the gingival third of the lingual surface of the anterior teeth. This patent does not address the problem of keeping the handle of the toothbrush away from the anterior teeth so that the bristles can completely contact the inside interproximal surfaces of the posterior teeth. It also does not address the problem of being able to see the inside interproximal surfaces of the posterior teeth when they are being brushed. Other U.S. Design patents such as U.S. Pat. Nos. Des. 336,369, 284,236, 359,167 and 268,795 show toothbrushes that do not address the concerns stated above. To overcome the limitations of those toothbrushes the present invention has been developed.

SUMMARY OF THE INVENTION

The present invention is a toothbrush that can be divided into three section. There is a head section having bristles, a handle section for griping the toothbrush and a connecting section for connecting the head section to the handle section. In two embodiments of the invention the head is parallel to and offset in a positive direction from the longitudinal axis of the handle so that the connecting section does not interfere with the anterior teeth. This allows perpendicular contact of the bristles with the lingual surface of the posterior teeth and the gingiva. The handle is offset above the head (positive offset) so that the connecting section and the handle do not obstruct the view of the surfaces of the posterior teeth while they are being cleaned. These embodiments allow for maximum effective cleaning of the hard to clean areas such as the lingual molar surfaces. In a third embodiment, the head is not parallel to and is offset below (negative offset) the longitudinal axis of the handle. The bristles are of equal length so that when they are placed flat against the lingual or buccal surfaces of the posterior teeth, the connecting section and the handle are away from the anterior teeth and the connecting section and the handle do not obstruct the view of the lingual or buccal surfaces of the posterior teeth while they are being cleaned. In any of the embodiments, the handles can be enlarged to allow for a better grip or a triangular shaped thumb rest, or a similar functioning shape, can be added for the same purpose. Another advantage of the third embodiment is that the same force can be applied to the bristles with less effort because of the angle of the handle with respect to the longitudinal axis of the head.

An object of the present invention is to provide a toothbrush with a head that is offset from the longitudinal axis of the handle to allow perpendicular contact with the lingual surfaces of the posterior teeth and the gingiva.

It is another object of the invention to provide a toothbrush with a connecting section that avoids contact with the anterior teeth and sill allows perpendicular contact with the lingual surfaces of the posterior teeth and the gingiva.

It is a further object of the invention to provide a toothbrush with a connecting section and handle that do not obstruct the view of the lingual or buccal surfaces of the posterior teeth while they are being cleaned.

It is a final object of the invention to provide a toothbrush with a connecting section and handle that allow the same force to be applied to the bristles with less effort.

The novel features of the present invention are set forth with particularity in the appended claims. The invention will best be understood from the following description when read in conjunction with the accompanying drawings in which:

DETAILED DESCRIPTION OF THE PREFERRED EMBODIMENT

The present invention has three embodiments, each of which can be divided into three sections. There is a head section having bristles, a handle section for gripping the toothbrush and a connecting section for connecting the head section to the handle section. Each embodiment facilitates perpendicular contact of the bristles with the lingual surfaces and embrasures of the posterior teeth while avoiding interference from the anterior teeth. The shape of the connecting sections also allows an unobstructed view of the lingual surfaces of the posterior teeth while they are being cleaned. The present invention is important because most gum disease occurs on the lingual gingival surfaces of the posterior teeth. Almost all prior art toothbrushes are capable of effectively cleaning the facial surfaces of the teeth however the embodiments of the present invention are more effective in cleaning the lingual surfaces of the posterior teeth including the internal embrasure.

Figure 1A:
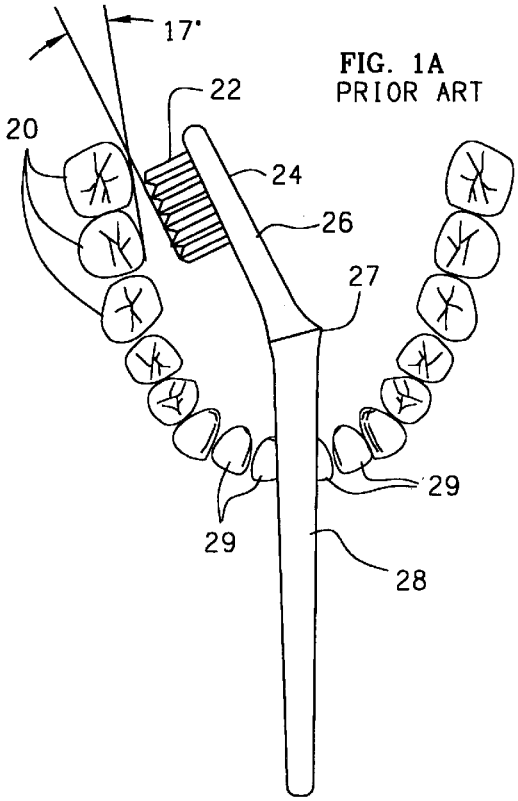
FIG. 1A PRIOR ART
FIGS. 1A and 1B are top views of prior art toothbrushes.

FIG. 1A shows a prior art toothbrush as it would be used to brush the lingual surfaces of the posterior teeth 20. As shown, only a portion of the bristles 22 contact the posterior teeth 20 on their lingual surfaces. The head 24 is attached to the connection section 26 at an angle as shown by bend 27. The connecting section is in turn connected to the handle 28. The limited contact of the bristles 22 with the posterior teeth 20 is caused by the handle 28 contact with the anterior teeth 29. The position of the connecting section 26 inhibits the ability of a person brushing their teeth to view the lingual surface of the posterior teeth 20 while they are being cleaned.

Figure 1B:
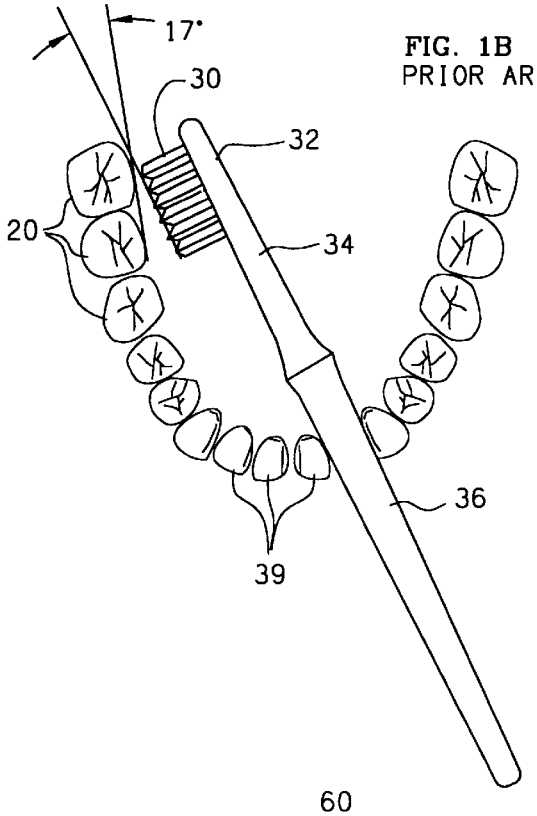
FIG. 1B PRIOR ART

FIG. 1B shows a prior art straight toothbrush with the same problem. In this figure, the bristles 30 are attached to the head 32 which is connected to the connecting section 34 that is in turn connected to the handle 36. Only a portion of the bristles 30 contact the lingual surfaces of the posterior teeth 20 because of interference between the handle 36 and the anterior teeth 29. In this figure there is no bend between the connecting section 34 and the handle 36. The position of the connecting section 34 also inhibits the ability of a person brushing their teeth to view the lingual surface of the posterior teeth 20 while they are being cleaned.

Figure 2:
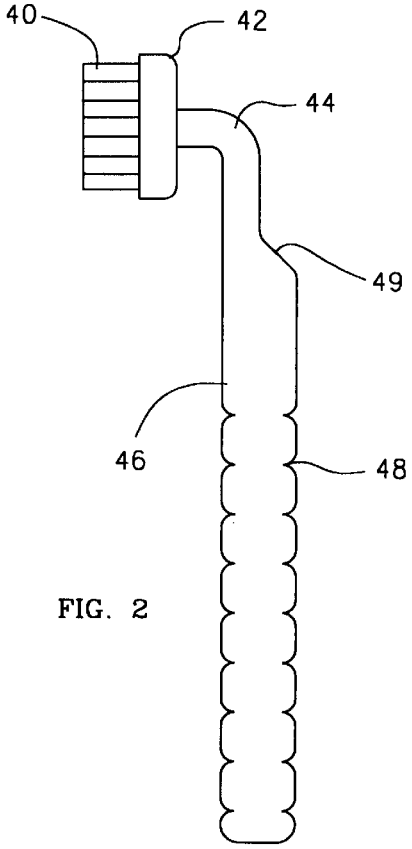
FIG. 2 is a side view of a first embodiment of the present invention.
Figure 3:
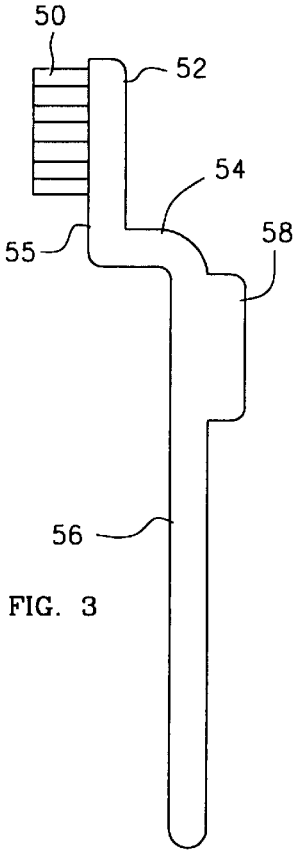
FIG. 3 is a side view of a second embodiment of the present invention.
Figure 4:
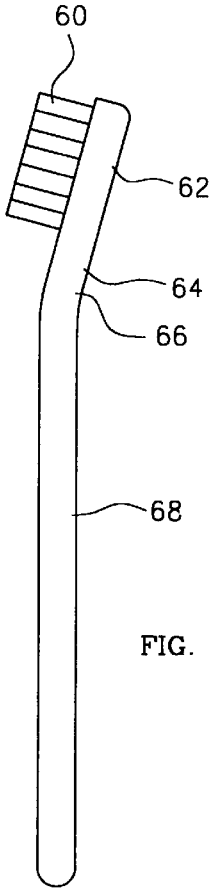
FIG. 4 is a side view of a third embodiment of the present invention.

FIGS. 2, 3 and 4 show three embodiments of the present invention. In FIG. 2, the bristles 40 and the head 42 are parallel to and offset in a positive direction from the longitudinal axis of the handle 46. This allows the bristles 40 to rest perpendicular against the lingual surfaces and the gingiva of the posterior teeth while the connecting section 44 allows the handle 46 to clear the anterior teeth. This arrangement also allows a person brushing their teeth to see the lingual surface of the posterior teeth while they are being cleaned. This is an advantage because a person can see if they are missing spots on the lingual surface that need to be cleaned. FIG. 2 also shows the handle 46 enlarged after point 49 to provide a better gripping surface. Ridges 48 can also be provided to enhance the ability of a person to grip and manipulate the toothbrush.

FIG. 3 shows an alternate embodiment in which the connecting section 54 is attached to one end 55 of the head 52 instead of to the middle of the head 52 as shown in FIG. 2. The bristles 50 and head 52 are parallel to and offset in a positive direction from the longitudinal axis of the handle 56. This arrangement also allows the bristles 50 to rest flat against the lingual surfaces of the posterior teeth while the connecting section 54 allows the handle 56 to clear the anterior teeth. As in FIG. 2, the connecting section 54 and handle 56 do not obstruct the view of the lingual surface of the posterior teeth while they are being cleaned. FIG. 3 shows a triangular thumb rest 58 molded as part of the handle 56. The thumb rest 58 improves the ability to grip and manipulate the toothbrush and can be made of any shape that functions in a similar manner.

FIG. 4 shows an alternate embodiment in which the bristles 60 and head 62 are offset in a negative direction from the longitudinal axis of the handle 68. The connecting section 64 has a bend 66 that causes the head 62 and the bristles 60 to be at an angle with the longitudinal axis of the handle 68. The distance between the bend 66 and the head 62 should be as short as possible so that the connecting section and handle 68 clear the anterior teeth when the posterior teeth are being cleaned. This arrangement the same advantages of the toothbrushes shown in FIGS. 2 and 3 in that the bristles 60 can lay flat against the lingual surface of the posterior teeth without obstructing the view of the lingual surface and without having interference between the handle 68 and the anterior teeth. These advantages will be better understood with reference to FIGS. 5 and 6 which show how the first and third embodiments of the present invention are used to clean the lingual surfaces of the posterior teeth.

Figure 5:
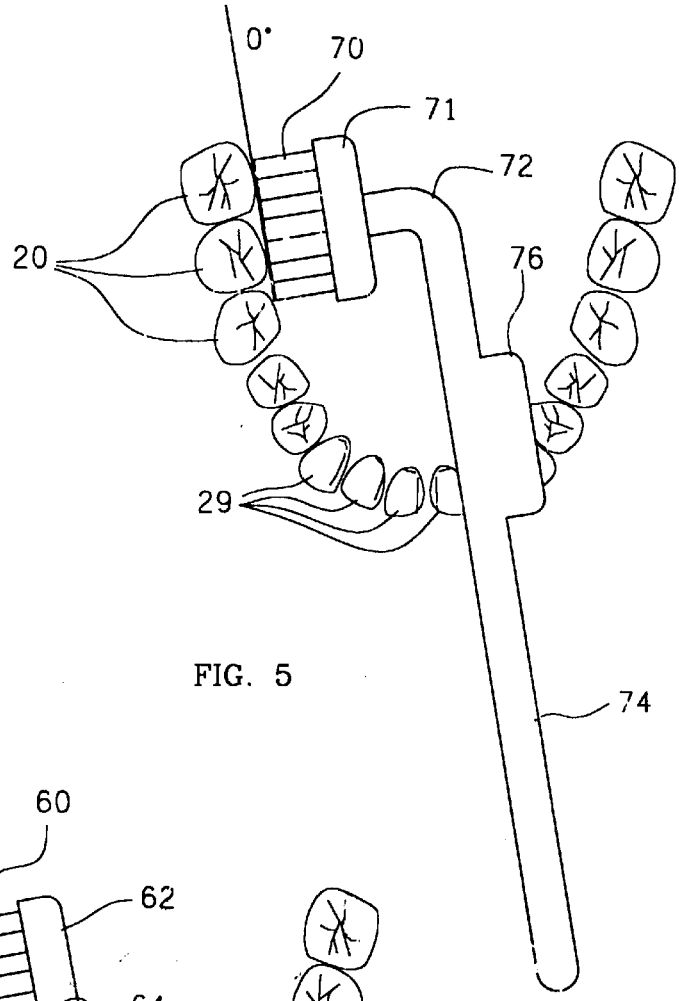
FIG. 5 is a top view of the first embodiment of the present invention being applied to clean the lingual surfaces of the posterior teeth.

FIG. 5 shows the bristles 70 laying flat against the lingual surfaces of the posterior teeth 20. The connecting section 72 causes the head 71 to be parallel to and offset in a positive direction from the longitudinal axis of the handle 74. This offset raises the handle 74 so that it does not interfere with the anterior teeth 29. As stated before this offset keeps the connecting section 72 and the handle 74 out of the way so that a person can better see the lingual surface while it is being brushed. FIG. 5 also shows that a triangular thumb rest 76 can be added to handle 74 to make the toothbrush easier to grip and manipulate.

Figure 6:
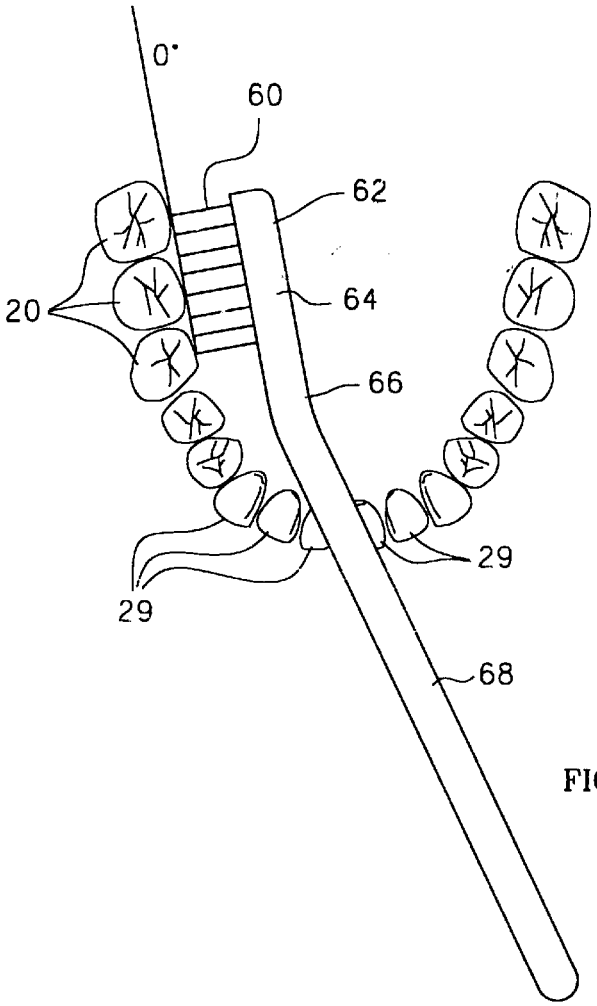
FIG. 6 is a top view of the third embodiment of the present invention being applied to clean the lingual surfaces of the posterior teeth.

FIG. 6 shows the third embodiment being used to clean the lingual surface of the posterior teeth 20. When the bristles 60 lay flat against the posterior teeth 20 the handle 68 clears the anterior teeth 29 due to the offset caused by bend 66 in connecting section 64. This offset also keeps the connecting section 64 and the handle 68 out of the way so that a person can see the lingual surface that is being brushed. This embodiment also has the advantage that the angle between the longitudinal axis of the head 62 and the handle 68 allow the same force to be applied to the bristles 60 with less effort.

While the toothbrushes of the present invention are shown with reference to FIGS. 1A through 6, the instant invention is not limited to the exact embodiments shown herein, for obvious modifications can be made by a person skilled in the art.

What is claimed is:

1. A toothbrush comprising:

an elongated handle section having a longitudinal axis and two ends, said elongated handle section extending to an end point at one of said ends, at least one ridge on the elongated handle section to provide a better gripping surface;

a straight elongated head section having a longitudinal axis and having a bristle attachment surface with a plurality of bristles of equal length extending from said bristle attachment surface in a direction away from said elongated handle section wherein the longitudinal axis of said straight elongated head section is parallel to and positively offset from said longitudinal axis of said elongated handle section;

a connecting section extending from said point on said elongated handle section towards said straight elongated head section and being connected to a top portion of said straight elongated head section.

* * * * *